United States Patent [19]

Mitchell

[11] Patent Number: 4,605,831

[45] Date of Patent: Aug. 12, 1986

[54] SWITCH FOR PROTECTING A FREON COMPRESSOR

[76] Inventor: Ronald R. Mitchell, 248 Azalea Cir., Vinton, Va. 24179

[21] Appl. No.: 737,862

[22] Filed: May 28, 1985

[51] Int. Cl.[4] ..... H01H 35/40

[52] U.S. Cl. ..... 200/83 R

[58] Field of Search ..... 200/61.04, 61.2, 81 R, 200/81.9 R, 83 R, 83 J, 83 A, 83 W, 83 S

[56] References Cited

U.S. PATENT DOCUMENTS

| | | | |
|---|---|---|---|
| 2,761,924 | 9/1956 | Keenan | 200/61.2 |
| 2,962,566 | 11/1960 | Lisac | 200/83 R |
| 3,161,740 | 12/1964 | Schniers et al. | 200/81 R |
| 3,293,390 | 12/1966 | Shaw | 200/61.2 X |

*Primary Examiner*—J. R. Scott

*Attorney, Agent, or Firm*—Norman B. Rainer

[57] ABSTRACT

A device for sensing pressure and temperature within the crankcase of a refrigerant compressor is adapted to protectively stop the operation of the compressor when temperature and pressure conditions within the crankcase permit existence therein of liquid refrigerant. The device utilizes a sealed vessel containing liquid refrigerant. The sealed vessel extends from a head portion downwardly into the crankcase fluid, and is provided with a pressure-displaceable membrane seal in the head portion. When the membrane expands due to high temperature within the crankcase, it causes closure of an electrical circuit. A pressure equalizing conduit equalizes the pressure between the crankcase and a chamber that surrounds said head portion.

5 Claims, 2 Drawing Figures

SWITCH FOR PROTECTING A FREON COMPRESSOR

BACKGROUND OF THE INVENTION

This invention concerns a device to be associated with the crankcase of a compressor utilized to compress freon refrigerant, and more particularly relates to a monitoring device adapted to detect the undesired presence of freon in said crankcase and stop the operation of the compressor when said presence of liquid freon is detected.

In various refrigeration devices utilizing a volatile freon halocarbon refrigerant, the refrigerant passes through a compression cycle which liquifies the gaseous refrigerant in preparation for a subsequent stage of evaporative cooling. Compression is achieved by means of a motordriven pistons which receives necessary oil lubrication from a crankcase. The lubricating oil confined within the crankcase is generally heated to a temperature above the saturation temperature of the refrigerant in order to vaporize away any trace amounts of liquid freon in the crankcase.

If a compressor is started with liquid refrigerant in the crankcase, there is a significant chance of catastrophic mechanical failure due to inadequate lubrication. Control systems have been disclosed which will prevent a compressor from operating when the oil temperature is too low, however, liquid phase freon may still be present because of the high pressures confined within the crankcase.

It is accordingly an object of this invention to provide a device responsive to temperature and pressure effects within the crankcase of a compressor, and capable of controlling the operation of the compressor within safe limits.

It is another object of the present invention to provide a device as in the foregoing object capable of determining when the temperature of the oil in the crankcase is low enough in relation to the pressure within the crankcase to permit the existence of liquid refrigerant within the crankcase, and to prevent operation of the compressor when such relationship is ascertained.

It is still another object of this invention to provide a device of the aforesaid nature of simple and rugged construction which may be economically manufactured and easily installed into operative association with the crankcase of a compressor.

These objects and other objects and advantages of the invention will be apparent from the following description.

SUMMARY OF THE INVENTION

The above and other beneficial objects and advantages are accomplished in accordance with the present invention by a device for sensing pressure and temperature within the crankcase of a refrigerant compressor and stopping the operation of the compressor when the sensed values of pressure and temperature are adverse, said device comprising:

(a) a pressure-retaining chamber having a rigid wall structure, (b) a sealed vessel containing liquid refrigerant, said vessel having (1) an elongated portion which extends through the wall of said chamber and is adapted to be positioned within said crankcase, and (2) a head portion positioned within said chamber, (c) pressure-displaceable means which seals the head portion of said sealed vessel, (d) electrical contact means disposed within said chamber in operative association with said pressure-displaceable means and communicating through said chamber wall to joinder with electrical conductors, said contact means being capable of making and breaking an electrical circuit which controls the operation of the compressor, (e) a pressure equalizing conduit having a proximal extremity which communicates with the interior of said chamber, and a distal extremity adapted to attach to said crankcase and communicate with the interior thereof, and (f) means associated with the elongated portion of said sealed vessel for enabling said portion to penetrate said crankcase while preventing leakage of the contents of said crankcase.

In preferred embodiments of the device, the sealed vessel contains the same refrigerant that is acted upon the compressor. The elongated portion of the sealed vessel is preferably a metal tube of circular cylindrical configuration. The pressure-displaceable means may be a flexible disc membrane or a bellows. The electrical contact means are disposed in a manner such that they are acted upon by the pressuredisplaceable means at a certain point of its movement to complete an electrical circuit.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 2:
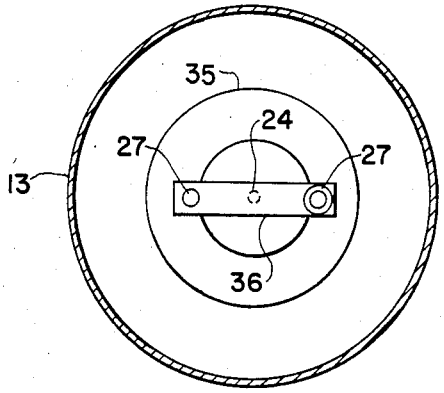
FIG. 2 is a top elevational view of the embodiment of FIG. 1.
Figure 1:
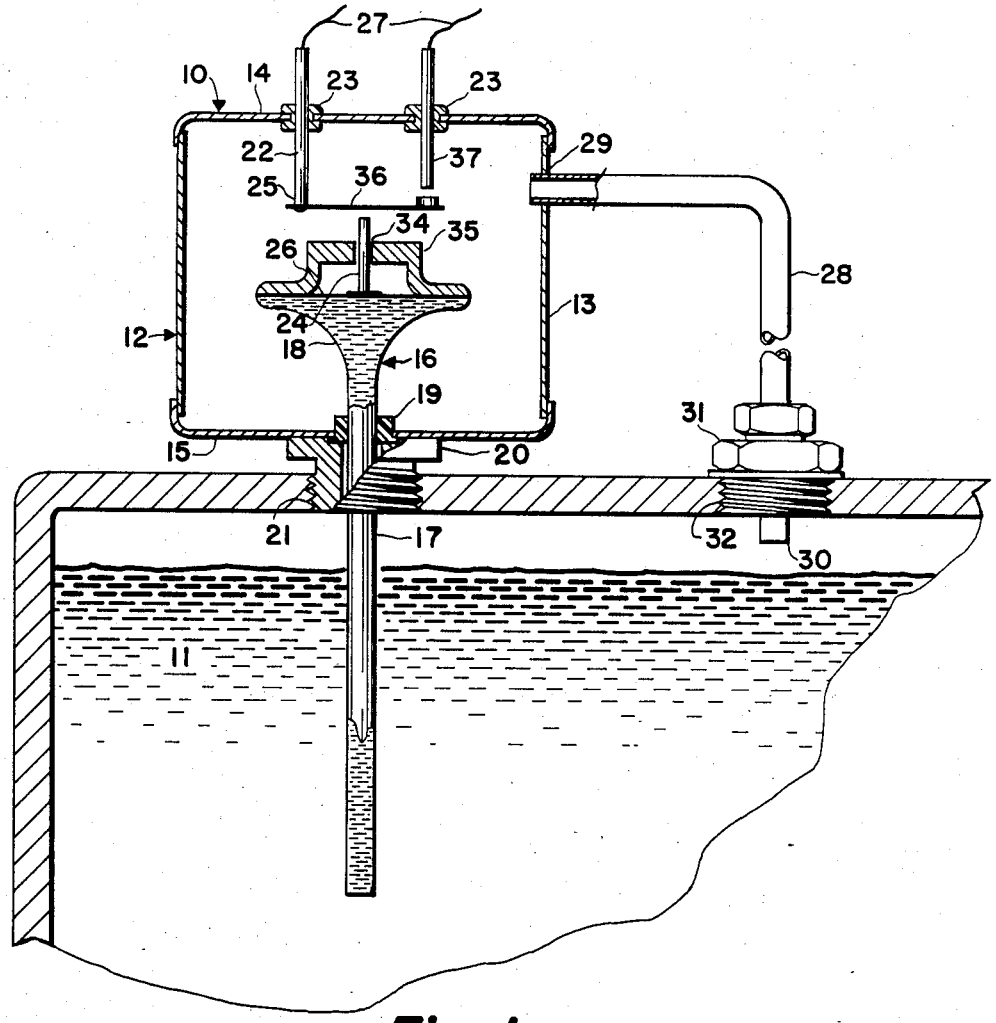
FIG. 1 is a sectional side view of an embodiment of the device of this invention shown in operative association with the crankcase of a refrigerant compressor.

Referring to the drawing, a device 10 of the present invention is shown in operative association with the crankcase 11 of a refrigerant compressor. The device is comprised of pressure-retaining chamber 12 having a circular cylindrical sidewall 13 and flat upper and lower cap members 14 and 15, respectively, welded to the extremities of sidewall 13. A sealed vessel 16, comprised of an elongated tube stem 17 and head 18, is positioned such that stem 17 passes through a pressure-tight seal 19 in lower cap 15, thereby disposing head 18 within chamber 12 and substantially centered upon the axis of sidewall 13. A sealing lock nut 20, positioned upon stem 17 below cap 15, permits secure leak-free penetration of the stem through threaded aperture 21 in crankcase 11, thereby positioning a significant length of said stem within the crankcase. A flexible circular disc membrane 26 located in said head in perpendicular disposition to said axis seals the uppermost extremity of sealed vessel 16. A push rod 24 rests in vertical abutment with membrane 26 at the center thereof. Said push rod slideably penetrates centered aperture 34 of rigid guide disc 35 affixed atop head 18.

A pair of rigid metal rods 22 and 37 penetrate upper cap 14 through pressure-tight seals 23. The lowermost extremity 25 of rod 22 has attached thereto flexible metal spring 26 which extends above push rod 24 to a distal extremity located below the lowermost extremity of rod 37. When push rod 24 is forced upwardly by membrane 26, it causes the distal extremity of spring 36 to contact the lowermost extremity of rod 37, thereby completing an electrical circuit. Electrical conductor wires 27 are affixed to the upper extremities of rods 22, and lead to an electrical switch of standard design capable of sensing the completion of an electrical circuit and controlling other circuitry based upon the "make" or "break" status of the sensed circuit.

A pressure equalizing conduit in the form of metal tubing 28 has a proximal extremity 29 which penetrates sidewall 13 of the chamber, thereby communicating with the interior of the chamber. The distal extremity 30 of said tubing extends through bushing collar 31 adapted to engage threaded aperture 32 of said crankcase, thereby enabling the distal extremity of the tubing to communicate with the interior of the crankcase.

In the operation of the device, the refrigerant fluid within stem 17 is heated to the prevailing temperature within the crankcase. A pressure is thereby generated within sealed vessel 16, said pressure being dependent upon the temperature and the nature of the refrigerant. The generated pressure urges membrane 26 upward to displace push rod 24. The pressure within the crankcase, communicated to the chamber by equalizing conduit 28, serves to drive said membrane downwardly. The actual position of membrane 26 is therefore dependent upon both the temperature and pressure within the crankcase.

For a given refrigerant, a critical height of membrane 26 is indicative of a condition wherein liquid refrigerant exists in the crankcase, and at said height the electrical circuitry inactivates the compressor. For example, when Freon 22 is the refrigerant, the device of this invention permits the compressor to operate when the pressure within sealed vessel 16 is 22 psi. greater than the crankcase pressure. As such pressure, the membrane is forced upwardly, thereby causing completion of the electrical circuit. When the pressure within vessel 16 falls to 7 psi. above the crankcase pressure, the membrane moves downwardly, thereby breaking the electrical circuit and preventing operation of the compressor. Said lower pressure indicates that the crankcase temperature is approaching the saturation temperature of the Freon. Under such conditions, Freon in liquid state can exist in the crankcase thereby diluting the crankcase oil to a point where its lubricating effect is lost.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A device for sensing pressure and temperature within the crankcase of a refrigerant compressor and stopping the operation of the compressor when the sensed values of pressure and temperature suggest the possible existence of liquid refrigerant within said crankcase, said device comprising:

(a) a pressure-retaining chamber having a rigid wall structure, (b) a sealed vessel containing liquid refrigerant, said vessel having (1) an elongated portion which extends through the wall of said chamber and is configured to be positioned within said crankcase, and (2) a head portion positioned within said chamber, (c) pressure-displaceable means which seals the head portion of said sealed vessel, (d) electrical contact means disposed within said chamber in operative association with said pressure-displaceable means and communicating through said chamber wall to joinder with electrical conductors, said contact means acting to make and break an electrical circuit which controls the operation of the compressor, (e) a pressure equalizing conduit having a proximal extremity which communicates with the interior of said chamber, and a distal extremity configured to communicate with the interior of said crankcase, and (f) means associated with the elongated portion of said sealed vessel for enabling said portion to penetrate said crankcase while preventing leakage of the contents of said crankcase.

2. The device of claim 1 wherein said sealed vessel contains the same refrigerant fluid that is acted upon by the compressor.

3. The device of claim 1 wherein the elongated portion of the sealed vessel is a metal tube of circular cylindrical configuration.

4. The device of claim 1 wherein said pressure displaceable means is a flexible disc membrane.

5. The device of claim 1 wherein the distal extremity of said pressure equalizing conduit is positioned within said crankcase above the level of the liquid therein.

* * * * *